US005918601A

United States Patent [19]

Ledany

[11] Patent Number: 5,918,601

[45] Date of Patent: Jul. 6, 1999

[54] VIBRATORY WRIST SUPPORT

[76] Inventor: Ori Ledany, 1550 Sandpebble Dr. #313, Wheeling, Ill. 60090

[21] Appl. No.: 08/757,594

[22] Filed: Nov. 29, 1996

[51] Int. Cl.[6] ..... A61F 5/37

[52] U.S. Cl. ..... 128/878; 128/879; 601/151

[58] Field of Search ..... 128/845, 846, 128/877, 878, 879, 882; 602/5, 13, 20, 21; 601/11, 33, 71, 72, 79, 81, 151

[56] References Cited

U.S. PATENT DOCUMENTS

| | | | |
|---|---|---|---|
| 2,291,785 | 4/1942 | Baudistel | 601/151 |
| 2,579,209 | 12/1951 | Smith | 601/151 |
| 2,675,800 | 4/1954 | Voorhees | 601/72 |
| 3,083,708 | 4/1963 | Gottfried | 601/151 |
| 4,580,553 | 4/1986 | Laib | 601/102 |
| 5,377,692 | 1/1995 | Pfeil | 128/844 |
| 5,601,529 | 2/1997 | Wollman | 601/81 |

*Primary Examiner*—Michael A. Brown
*Attorney, Agent, or Firm*—Welsh & Katz, Ltd.

[57] ABSTRACT

A vibratory wrist support for use with a computer keyboard. The vibratory wrist support has a substantially cylindrical outer surface. The vibratory wrist support contains a vibratory mechanism that is capable of imparting a vibratory action to the surface of the vibratory wrist support.

11 Claims, 3 Drawing Sheets

VIBRATORY WRIST SUPPORT

BACKGROUND OF THE INVENTION

The present invention is a support for wrists during a repetitive typing operation. More particularly, the present invention relates to a vibratory wrist support for supporting the wrists with relation to a keyboard.

As society becomes increasingly more reliant on computers for organizing and conveying information, people are increasingly using keyboards to input and manipulate information on the computers. Over time, the repetitive action of movement of the fingers when typing on keyboards produces repetitive stress injuries on certain people. One common repetitive stress injury in the wrist area is carpal tunnel syndrome. Depending on the severity of carpal tunnel syndrome, the person may be forced to reduce the amount of time the person uses the keyboard. In extreme situations, the person may be precluded from using the keyboard. Each of these situations inhibit the person's ability to perform their occupation which could leave the person unemployed.

To prevent and/or cure these repetitive stress injuries, a variety of devices have been developed. In certain situations, it is possible for the person to wear wrist braces that support the wrist when performing the typing operations. A drawback of the wrist rest is that the wrist braces limit the degree to which the wrist and/or fingers can be moved. Such a limitation may have an adverse effect on the person's ability to perform their occupation.

Alternatively, various support devices have been developed to support a person's wrist as they are performing typing operations. These wrist supports are commonly placed in front of the computer keyboard and are frequently manufactured from a resilient material that provides a cushioning action.

SUMMARY OF THE INVENTION

The vibratory wrist support of the present invention is suitable for use in conjunction with a computer keyboard. The vibratory wrist support has a substantially cylindrical outer surface. The vibratory wrist support also contains a vibratory mechanism that is capable of imparting a vibratory action to the surface of the vibratory wrist support.

DETAILED DESCRIPTION OF THE PREFERRED EMBODIMENTS

Figure 1:
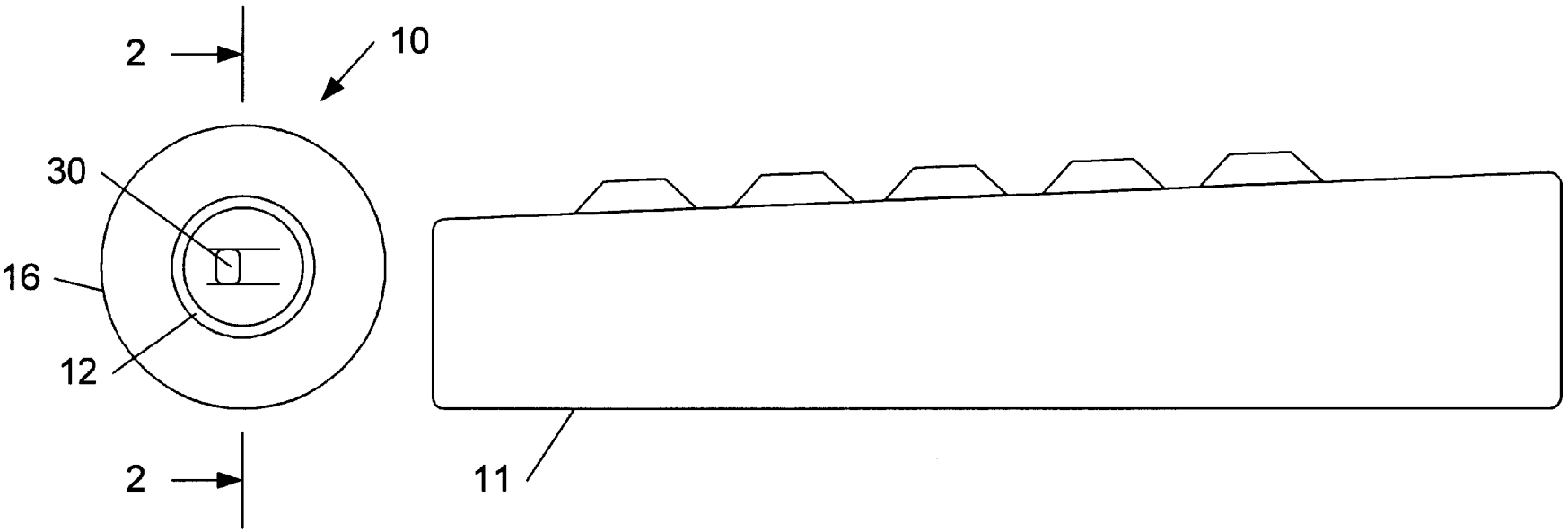
FIG. 1 is a side view of a vibratory wrist support according to the present invention in conjunction with a keyboard.

A vibratory wrist support according to the present invention is most clearly illustrated at 10 in FIG. 1. The vibratory wrist support 10 supports a person's wrists (not shown) when the person is performing a repetitive action using the person's wrists, hands, and fingers such as when typing on a computer keyboard 11. In addition to supporting the person's wrists, the vibratory wrist support 10 is capable of producing a vibratory action that helps to reduce fatigue in the person's wrists.

Figure 2:
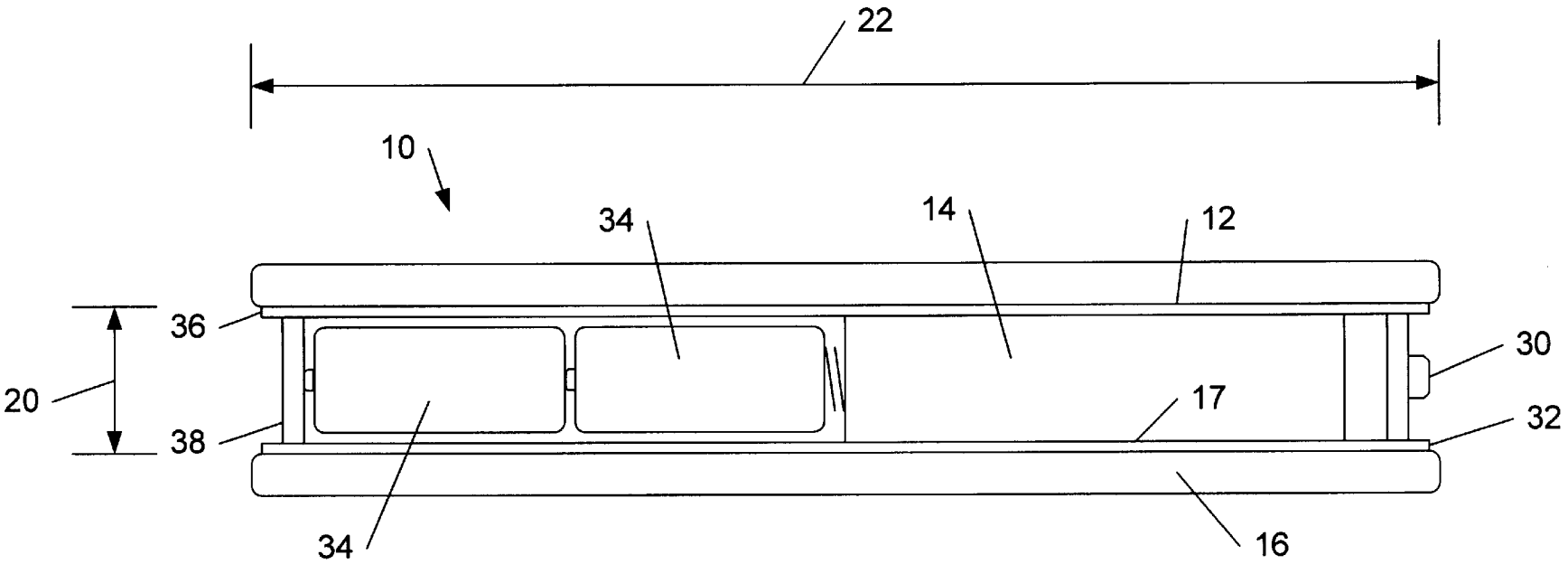
FIG. 2 is a sectional view of the vibratory wrist support, which is taken along a line 2—2 in FIG. 1.

The wrist rest 10 is preferably constructed with three primary components: a substantially cylindrical sleeve 12, a vibratory mechanism 14, and a resilient sleeve 16, as most clearly illustrated in FIG. 2. The cylindrical sleeve 12 preferably has a substantially cylindrical bore 17 formed therein. The bore preferably extends from a first end 32 of the cylindrical sleeve 12 to a second end 36 of the cylindrical sleeve 12. Depending on the intended use of the vibratory wrist support, the cylindrical sleeve 12 may be fabricated from either plastic or steel.

The cylindrical sleeve 12 preferably has a diameter 20 of between about 1½ inches and 2 inches depending on the height of the computer keyboard with which the vibratory wrist support 10 is to be used. A length 22 of the cylindrical member 12 is preferably selected based upon the width of the computer keyboard that the wrist support 10 is to be used in conjunction with so that the vibratory wrist support 10 spans substantially the entire length of the computer keyboard. This enables the wrist support 10 to support a person's wrist along the entire length of the computer keyboard.

The vibratory mechanism 14 is preferably placed at an intermediate location within the bore 17. While FIG. 2 illustrates that the vibratory wrist support 10 contains a single vibratory mechanism 14, a person of ordinary skill in the art will appreciate that it is possible to use more than one vibratory mechanism 14 depending on the length and width of the vibratory wrist support 10.

The vibratory mechanism 14 is preferably operated using a switch 30 that is fixedly mounted proximate to the first end 32 of the cylindrical sleeve 12. The switch 30 may either include an on-off switch or a variable switch, which allows the intensity of the vibrations provided by the vibratory mechanism 16 to be varied.

The vibratory mechanism 14 is preferably powered by at least one battery 34. The size and number of the batteries 34 is selected based on the size of the vibratory mechanism 14. The battery 34 is removably mounted in the cylindrical member 12 opposite the switch 30 so that the battery 34 may be accessed through the second end 36 of the cylindrical member 12. The battery 34 is retained in the cylindrical member 12 using an end cap 38 that removably engages the cylindrical member 12.

The resilient sleeve 16 is selected with an inner diameter that is approximately equal to an outer diameter of the cylindrical member 12. This configuration allows the resilient sleeve 16 to be retained in a stationary relationship with respect to the cylindrical member 12. The resilient sleeve 16 is preferably selected with a length that preferably extends beyond the first and second ends 32, 36 of the cylindrical member 12.

The resilient sleeve 16 is preferably fabricated from an expanded foam. A person of ordinary skill in the art will appreciate that is possible to select expanded foam materials having a variety of densities and resiliencies based on amount of weight that the vibratory mechanism is intended to support and the thickness of the resilient sleeve 16. It is also possible to construct the resilient sleeve 16 with a two-part construction in which a lower layer is fabricated from a more dense expanded foam and an outer layer is fabricated from a less dense expanded foam.

The diameter of the cylindrical member 12 and the thickness of the resilient sleeve 16 are selected based on a height of the computer keyboard 11 with which the vibratory wrist support 10 is to be used. The vibratory wrist support 10 preferably has a height that is greater than a height of the computer keyboard 11, as most clearly illustrated in FIG. 1.

Figure 3:
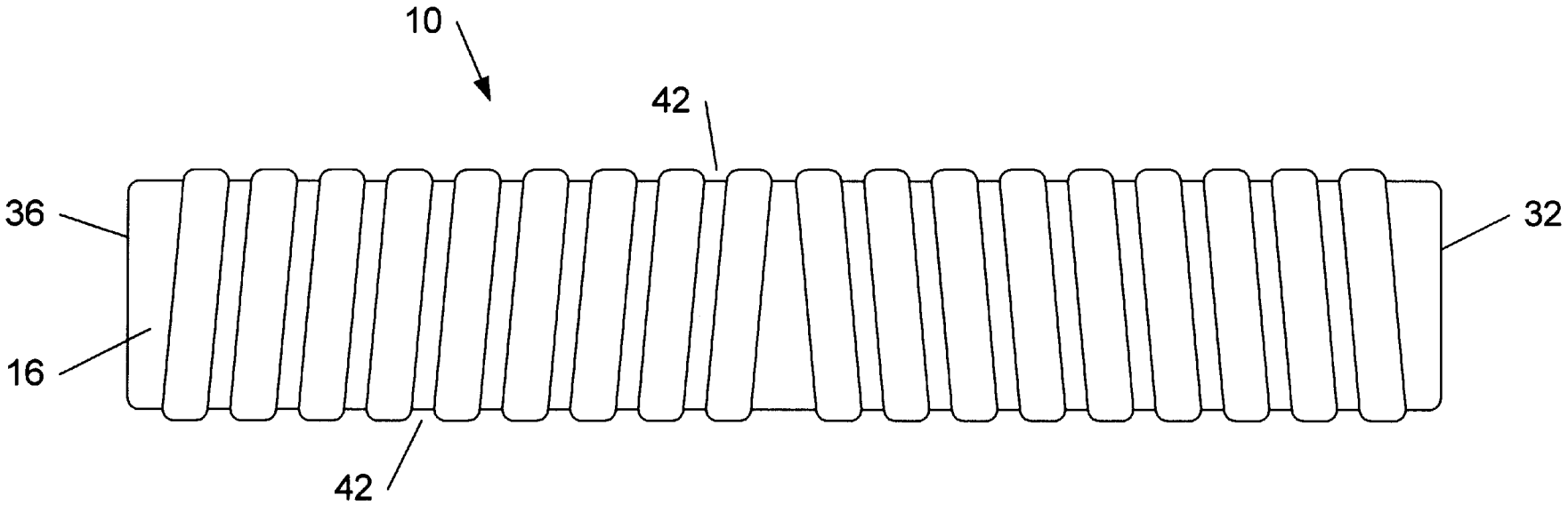
FIG. 3 is a top view of an alternative embodiment of the vibratory wrist support.

An outer surface 40 of the resilient sleeve 16 may be formed with a pattern to enhance the massaging action provided by the vibratory wrist support 10. One such pattern is a plurality of parallel indentions 42, as most clearly illustrated in FIG. 3. The indentions 42 are preferably oriented at an angle $\alpha$ of between about 10 and 30 degrees. Even more preferably, the indentions 42 proximate to the first and second ends 32, 36 are preferably oriented towards a center of the vibratory wrist support 10.

The indentions 42 provide a massaging action when the wrists are placed on the vibratory wrist support 10 and then moved in a forward or backward motion so as to roll the vibratory wrist support 10 with respect to the wrists.

The vibratory mechanism 14 provides a massaging action when wrists are placed upon the vibratory wrist support 10. This massaging action helps to prevent and/or cure carpal tunnel syndrome by stimulating the flow of blood and nerve action in the wrist area. Activating the vibratory mechanism 14 at selected periods throughout the work day may prolong the productivity of the person using the vibratory wrist support 10.

When the vibratory mechanism 14 is selected with a variable intensity, a low intensity setting may be used throughout the work day while the person is using the computer keyboard 11 because the low intensity would not interfere with the operation of the keyboard. Alternatively, a higher intensity setting may be used a selected periods of the work day. When using the high intensity setting, it is typically necessary for the person to discontinue using the keyboard during the selected period because the vibrations impair the person's ability to accurately type on the computer keyboard.

Although the present invention has been described with reference to preferred embodiments, workers skilled in the art will recognize that changes may be made in form and detail without departing from the spirit and scope of the invention.

What is claimed is:

1. A vibratory wrist support for use with a computer keyboard, the vibratory wrist support comprising:

a cylindrical member having an outer surface and bore extending therethrough;

a vibratory mechanism mounted within the bore; and a resilient member extending over and substantially covering the outer surface.

2. The vibratory wrist support of claim 1, wherein the cylindrical member is fabricated from steel or plastic.

3. The vibratory wrist support of claim 1, wherein the resilient member is fabricated from an expanded foam.

4. The vibratory wrist support of claim 1, wherein the vibratory mechanism is capable of providing a massaging action to a person's wrists when the person places the wrists upon the vibratory wrist support.

5. The vibratory wrist support of claim 4, wherein the massaging action provided by the vibratory mechanism is variable.

6. The vibratory wrist support of claim 5, wherein the resilient member has an outer surface with a plurality of indentions formed therein.

7. The vibratory wrist support of claim 6, wherein the indentions are oriented at an angle of between about 10 and 30 degrees.

8. The vibratory wrist support of claim 7, wherein the indentions are oriented towards a center of the vibratory wrist support.

9. A method of reducing fatigue associated with using a computer keyboard, the method comprising:

placing a vibratory wrist support with relation to the keyboard so that the vibratory wrist support is capable of supporting a person's wrist when the person is typing on the computer keyboard; and emitting vibratory waves from the vibratory wrist support, wherein the vibratory waves are transmitted to the person's wrists when the wrists are placed upon the vibratory wrist support.

10. The method of claim 9, wherein an intensity of the vibratory waves emitted from the vibratory wrist support is variable.

11. The method of claim 9, and further comprising applying a massaging action to the person's wrists, wherein the massaging action is provided by a plurality of intentions formed into an outer surface of the vibratory wrist support.

* * * * *